US010088138B2

(12) United States Patent
Shoulders

(10) Patent No.: US 10,088,138 B2
(45) Date of Patent: Oct. 2, 2018

(54) TACTICAL FLASHLIGHT WITH DUAL EMITTERS AND TAIL CAP CONTROL

(71) Applicant: Bayco Products, Inc., Wylie, TX (US)

(72) Inventor: Aaron Paul Shoulders, Sachse, TX (US)

(73) Assignee: Bayco Products, Inc., Wylie, TX (US)

( * ) Notice: Subject to any disclaimer, the term of this patent is extended or adjusted under 35 U.S.C. 154(b) by 43 days.

(21) Appl. No.: 15/377,440

(22) Filed: Dec. 13, 2016

(65) Prior Publication Data

US 2017/0299165 A1 Oct. 19, 2017

Related U.S. Application Data

(60) Provisional application No. 62/322,488, filed on Apr. 14, 2016.

(51) Int. Cl.
*F21V 23/04* (2006.01)
*F21L 4/02* (2006.01)
*F21Y 115/10* (2016.01)

(52) U.S. Cl.
CPC ..... *F21V 23/0421* (2013.01); *F21L 4/027* (2013.01); *F21Y 2115/10* (2016.08)

(58) Field of Classification Search
CPC .... F21L 4/02–4/027; F21L 4/08; F21L 4/085; F21V 23/0421; H02J 7/0044; H02J 7/0045
See application file for complete search history.

(56) References Cited

U.S. PATENT DOCUMENTS

| | | | | |
|---|---|---|---|---|
| 3,648,045 | A * | 3/1972 | Le Vantine | F21S 8/003 362/265 |
| 4,563,727 | A * | 1/1986 | Curiel | F21L 4/08 136/251 |
| 4,939,628 | A * | 7/1990 | Wang | F21L 4/005 200/60 |
| 7,222,995 | B1 * | 5/2007 | Bayat | F21L 4/027 362/327 |
| 8,460,813 | B2 | 6/2013 | Lerner et al. | |
| 8,548,633 | B2 | 10/2013 | Adams et al. | |
| 8,979,298 | B1 * | 3/2015 | Wang | F21L 4/027 362/184 |
| 2005/0122710 | A1 * | 6/2005 | Kim | F21L 4/027 362/157 |
| 2005/0271934 | A1 | 12/2005 | Kiger et al. | |
| 2010/0090612 | A1 * | 4/2010 | Spartano | F21L 4/027 315/287 |

(Continued)

OTHER PUBLICATIONS

Sunwayman G25C, retrived from Internet Archive Wayback Machine on Mar. 25, 2018, published at latest May 23, 2015.*

*Primary Examiner* — Bao Q Truong
*Assistant Examiner* — Steven Horikoshi
(74) *Attorney, Agent, or Firm* — Whitaker Chalk Swindle & Schwartz PLLC; Stephen S. Mosher

(57) ABSTRACT

A tactical carry flash light includes a dual independent switch assembly for independently controlling first and second light emitters. The switch assembly is mounted in a tail cap of the flash light housing to provide operation of all modes by the user's thumb or finger. The housing encloses a battery pack that includes conductive elements, enclosed within an insulating sleeve, that enable the independent control of the first and second light emitters.

23 Claims, 5 Drawing Sheets

(56) References Cited

U.S. PATENT DOCUMENTS

| | | | | |
|---|---|---|---|---|
| 2010/0231142 | A1* | 9/2010 | Yoon | F21L 4/027 315/312 |
| 2011/0235316 | A1* | 9/2011 | Opolka | F21L 4/027 362/206 |
| 2013/0265001 | A1 | 10/2013 | Popper et al. | |
| 2013/0271967 | A1* | 10/2013 | Liu | F21L 4/00 362/186 |
| 2013/0343042 | A1 | 12/2013 | Windom | |
| 2014/0049223 | A1 | 2/2014 | Berger | |
| 2014/0232262 | A1* | 8/2014 | Wu | H05B 33/0857 315/33 |
| 2015/0373796 | A1* | 12/2015 | Bahrehmand | H05B 33/0815 315/129 |
| 2016/0161069 | A1* | 6/2016 | Lam | F21L 4/027 362/205 |

* cited by examiner

TACTICAL FLASHLIGHT WITH DUAL EMITTERS AND TAIL CAP CONTROL

CROSS REFERENCE TO RELATED APPLICATIONS

The present application claims priority to U. S. Provisional Patent Application Ser. No. 62/322,488 filed Apr. 14, 2016 by the same inventor and entitled BATTERY PACK WITH SWITCHED OUTPUTS.

BACKGROUND OF THE INVENTION

1. Field of the Invention

The present invention generally relates to battery operated lighting devices and more particularly to apparatus for tactical carry flash light devices having independently switched control of multiple lighting functions.

2. Background of the Invention and Description of the Prior Art

Lighting devices for "tactical carry" applications are widely used by police, fire, governmental, and public safety personnel. Tactical carry in the case of flashlights, for example, means that the lighting device is designed to be carried in the user's hand, and configured to be operated—turned ON and OFF, etc.—by the user with the same hand used to carry the device.

One type of flash light provides several lighting modes of a single beam—for example adjustable brightness levels, a strobe feature, etc.—that are controlled by one or more switches.

Another type of tactical flash light provides lighting modes from two emitters but are controlled by a single switch such that the two emitters cannot be operated independently at the same time.

Another type of tactical flash light is configured to be mounted on a helmet so that the user's hands are free for carrying equipment. However, such a light is not conveniently controlled when the user's hands are otherwise occupied.

Another type of tactical light provides two light beams—e.g., both flash light and flood light beams—from different light emitters but requires switches to control them that cannot be operated conveniently by the same hand that holds the flash light.

There is thus a need for a tactical flash light having separate flash light and flood light beams that are independently and easily controlled by the same hand that is holding the tactical light.

SUMMARY OF THE INVENTION

In one embodiment, a dual independent switch assembly is disclosed for a flash light housed in a tubular metal housing enclosing a battery pack, a control circuit having first and second inputs, and first and second independently operated light emitters. The dual switch assembly includes a switch assembly including independent first and second single pole switches mounted next to each other on a switch board within a removable metal end cap, each switch having a first contact coupled with a first common circuit to a first battery terminal and to the metal end cap. A second contact of the first switch is coupled via a first conductor path disposed through the battery pack to the first control circuit input for controlling activation of the first light emitter; and a second contact of the second switch is coupled via a second conductor path disposed through the battery pack to the second control circuit input for controlling activation of the second light emitter. Further, the combination is completed by electrically connecting the battery so that it energizes the control circuit whenever the battery pack is installed in the housing.

In one aspect, each first and second switch includes a push button actuator in proximate relationship on the end of the metal tail cap for independently connecting the first battery terminal to the first and second control circuit inputs via the respective first and second signal conductors and closed contacts of the first and second switches.

In another aspect, a third conductor path comprising an electrical connection through the first common circuit on the switch assembly, a metal retaining ring, the metal housing, a contact spring, and a second common circuit on the control circuit provides a common return connection between the negative terminal of the battery pack and the control circuit.

the first and second control circuits are provided by a programmed, low-power microcontroller that is configured to remain in a sleep mode except when either first or second switch is operated by a user, and the microcontroller is configured to draw less than 2 microAmperes during the sleep mode.

In another aspect, the battery pack comprises a cylindrical battery and first and second terminal boards disposed adjacent each battery terminal, each terminal board having outer and inner circular circuit patterns on both sides of the respective terminal board and connected through vias, the outer and inner circular circuit patterns disposed concentric with a central opening in each terminal board. In addition, a first conductor is electrically connected at each end thereof between the outer circular circuit patterns of the first and second terminal boards and a second conductor is electrically connected at each end thereof between the inner circular circuit patterns of the first and second terminal boards. The battery pack assembly may be enclosed in a sleeve formed of a thin electrical insulator surrounding the battery and enclosing the battery, first and second terminal boards, and the first and second conductors.

DETAILED DESCRIPTION OF THE INVENTION

Figure 1:
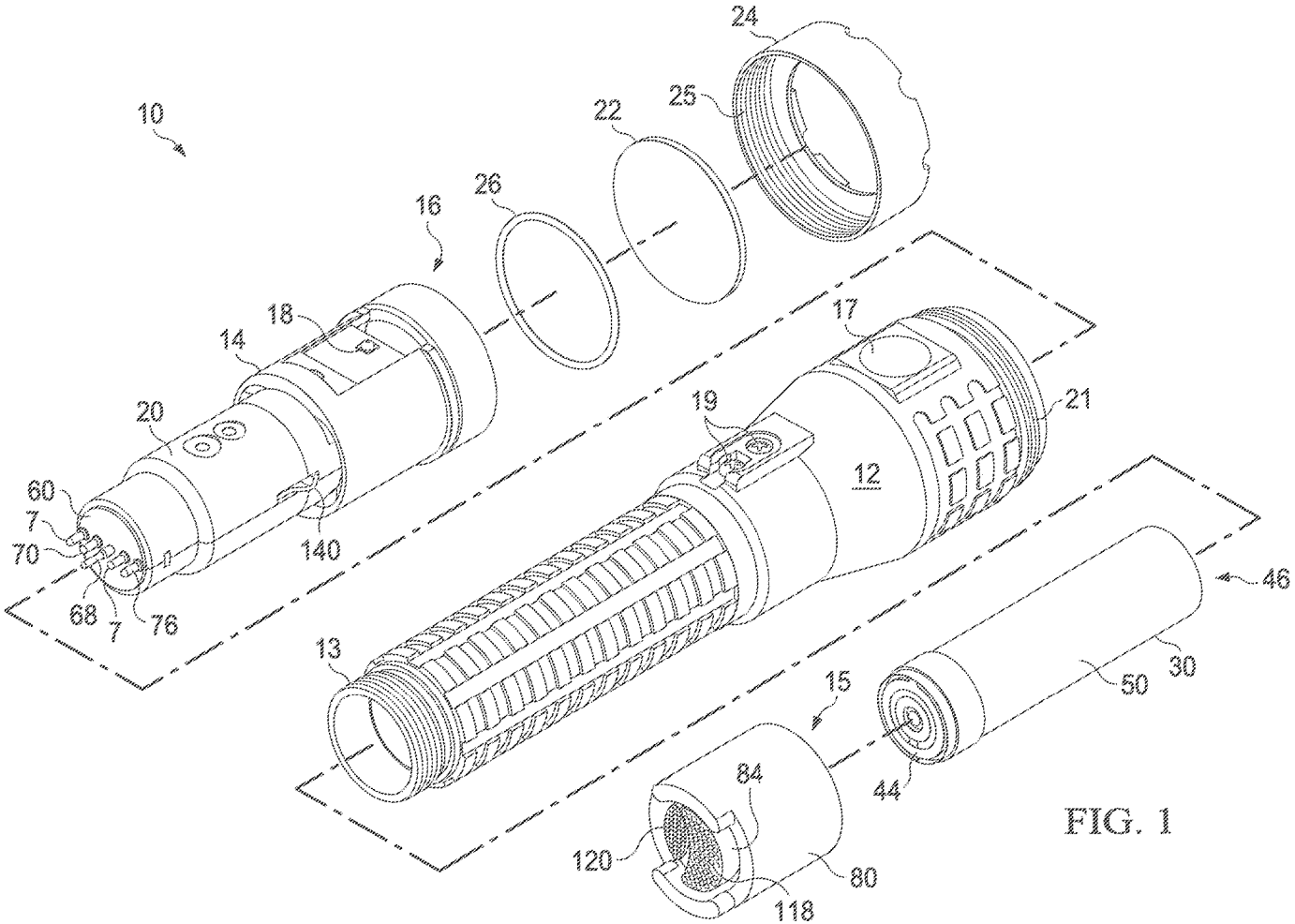
FIG. 1 illustrates a partially disassembled perspective view of one embodiment of the invention depicting four subassemblies—the housing, and the control circuit, battery pack, and tail cap assemblies.

An advance in the state of the art is disclosed herein of an invention of a tactical flash light that provides at least two independent flash and flood light beams controlled by separate switches, both operable by a user's thumb or finger as the light is grasped by the user's hand. In effect, the invention incorporates two separate flashlights in one compact, cylindrical housing that are powered by a common battery pack. As frequently used, the tactical flash light is held next to the user's head with one hand while the other hand is otherwise active. This invention overcomes the problem of how to provide a flash light device that is held in the "tactical carry" position, with fully independent switching located on the tail end of the device so that the functions of both flash light and flood light beams could be switched by the user's thumb or finger. In typical use, the flash light beam is axially-directed forward and the flood light beam is laterally-directed downward toward the ground or a floor.

The solution to the above problem is provided by a structure that incorporates two switch mechanisms in close proximity in the tail end—e.g., the tail cap—of the flash light device so the switches may be easily controlled by one finger or thumb. This structure, heretofore not available in a tactical carry light, is combined with a circuit that requires no ON/OFF switching. As long as the battery pack is installed in the housing of the tactical light with the tail cap secured, the control circuits for both flash and flood light beams (but not the light emitters) are energized but draw little or no current. This feature is provided by use of a low-power microcontroller that enters a sleep mode when no input is in a LOW state in the illustrated embodiment. The switching control of the two beams is separately coupled through the battery pack portion of the flash light to the control circuits and emitters located at the opposite, forward end of the battery pack. The two switch mechanisms are positioned and structured so that their operation is ergonomic and easy to learn. The invention is well-suited to tactical carry lights that are housed in small, cylindrical housings where compact packaging is necessary.

The exemplary embodiment shown in the attached drawings is assembled from four principle sections: a control circuit assembly, a battery pack assembly, a tail cap (or end cap) assembly, and a housing assembly that includes the first and second LED emitters. The control circuit assembly includes a first PC board with circuitry for operating the LED emitters and a second "connector" PC board that interfaces between a positive terminal board in the battery pack and the first PC board. The battery pack includes a cylindrical battery, separate positive and negative terminal boards (one at each end of the battery), first and second conductive strips that connect between corresponding conductive traces on the terminal boards, and an insulating sleeve that encloses the components of the battery pack. The control circuit assembly and the battery pack assembly are housed in the tubular housing assembly, with the control circuit assembly in the forward portion near the first and second LED emitters, followed by the battery pack assembly in the middle portion of the housing assembly. The housing and the tail cap are formed of metal, or at least may have a metalized interior surface for reasons that will become clear.

The battery pack houses a battery, typically one or two cells placed end-to-end in series, and an assembly of several signal circuits formed on printed circuits disposed adjacent the positive and negative battery terminals and connected through individual conductors. The assembly of the battery cell(s) and the signal circuits is enclosed in an insulating sleeve to form the battery pack unit.

The tail cap (or end cap) assembly contains a switch circuit PC board that includes first and second switches mounted on the PC board. The switch circuit includes conductor traces for signaling ON and OFF control inputs (these inputs are connections to ground, to pull a control input pin of the respective control circuit LOW in this embodiment) to the control circuit assembly via the first and second conductive strips in the battery pack assembly. The switch circuit assembly includes interfacing connectors (configured as "pogo pins," spring-loaded terminal pins installed in the switch circuit PC board) from the switch circuit assembly to the negative terminal board in the battery pack assembly. The tail cap assembly further includes a metal retaining ring that secures the switch circuit assembly within the tail cap in such a way as to connect a ground trace surrounding the switch circuit assembly to the inner surface of the metal tail cap. The ground trace on the switch circuit assembly PC board provides a connection between the retaining ring and the negative terminal of the battery pack, thereby providing the main system ground through the switch circuit assembly, the metal housing of the flash light, an internal ground contact between the housing inner surface and the ground circuit traces on the control circuit PC board.

The architecture of the illustrated embodiment is configured to provide completely independent switching control of the flash and flood light beams, including operating them at the same time through their respective modes, using only the user's thumb (or index finger, for example) of the hand that is holding the flashlight. While it is industry standard practice to provide one control switch on the tail cap of tactical flash lights, providing two independent control switches on the tail cap to control both flash light and flood light beams independently has not been previously available. To provide these features required engineering each of the four principle assemblies in a novel combination to cooperatively participate in the signaling of the user's intentions to the LED emitter(s) needed at the moment of use.

FIG. 1 illustrates a partially disassembled perspective view of one embodiment of a tactical carry flashlight 10 according to the invention. The four major assemblies are the housing 12, the control circuit assembly 14, the battery pack assembly 30, and the tail cap assembly 80. The housing 12 in the illustrated embodiment may preferably be a tubular, cast metal structure shaped to receive the control circuit assembly 14 and the battery pack assembly 30 within its hollow interior. The housing 12 includes exterior threads 21 that match the interior threads 25 of a lens cap 24. Similarly, the housing 12 includes exterior threads 13 that match the interior threads 110 of the tail cap assembly 80. Also shown in FIG. 1 are a flood light lens 17 and charging terminals 19. In an alternate embodiment, the housing 12 may be a molded of a synthetic material that is metalized on its interior surface and the threaded portion that joins to the tail cap to provide an electrically conductive surface.

Figure 4:
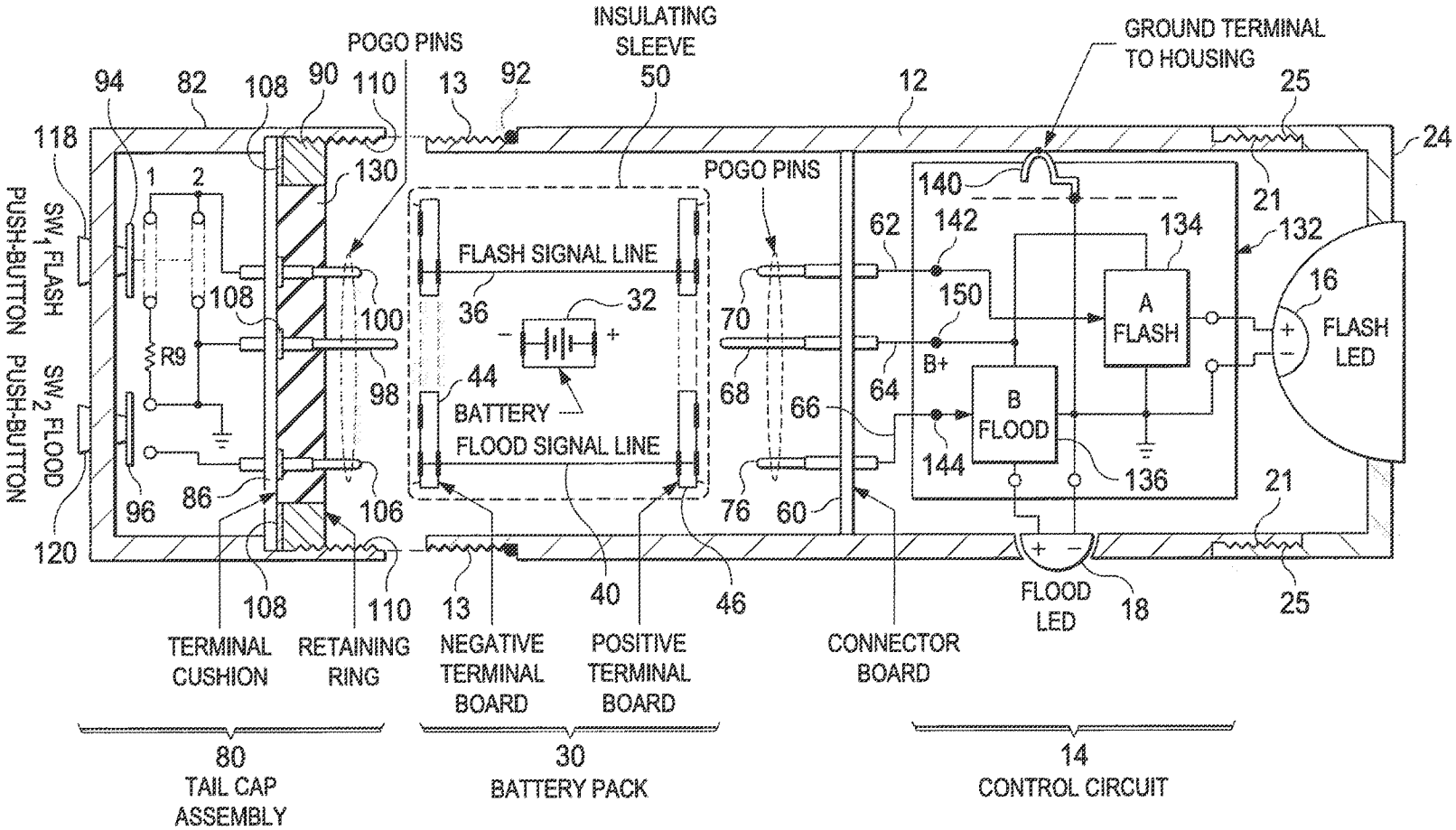
FIG. 4 illustrates a pictorial schematic drawing of the electrical and mechanical relationships of the embodiment of FIG. 1.

The control circuit assembly 14, which may be inserted into the forward end of the housing 12 and retained therein by the lens cap 24 after installing the O-ring 26 and the lens 22, includes a flashlight LED assembly 16 within the forward end of the control circuit assembly 14, and a flood light LED assembly 18 disposed in a side of the control circuit enclosure 20. The control circuit enclosure 20 may be a two-piece, split cylindrical shell to facilitate service access. Extending from the side of the enclosure 20 is a bare wire contact 140 shaped to provide electrical contact between the control circuit 132 and the housing 12, as shown in FIG. 4 to be described. A connector board 60 equipped with "pogo pin" terminals is part of the control circuit assembly 14 and is disposed within the end of the enclosure 20. Pin 68 located in the center of the connector board 60 provides electrical connection between the positive terminal 34 of the battery 32 via the pin 68 and a wire 64 connected to the positive supply terminal 150 ("B+") of the control circuit 132. Pins 74, 76 (there are two pins connected to the outer circular trace 42 on the positive terminal board 46) provide a signal path from conductor 40 in the battery pack 30 to an input of the flood emitter circuit 136 ("B") on control circuit 132. Pins 70, 72 (there are also two pins connected to a smaller inner circular trace 38 on the positive terminal board 46) provide a signal path from conductor 36 in the battery pack 30 to an input of the flash emitter circuit 134 ("A") on control circuit 132. See FIG. 4 for a schematic of these connections.

Figure 2:
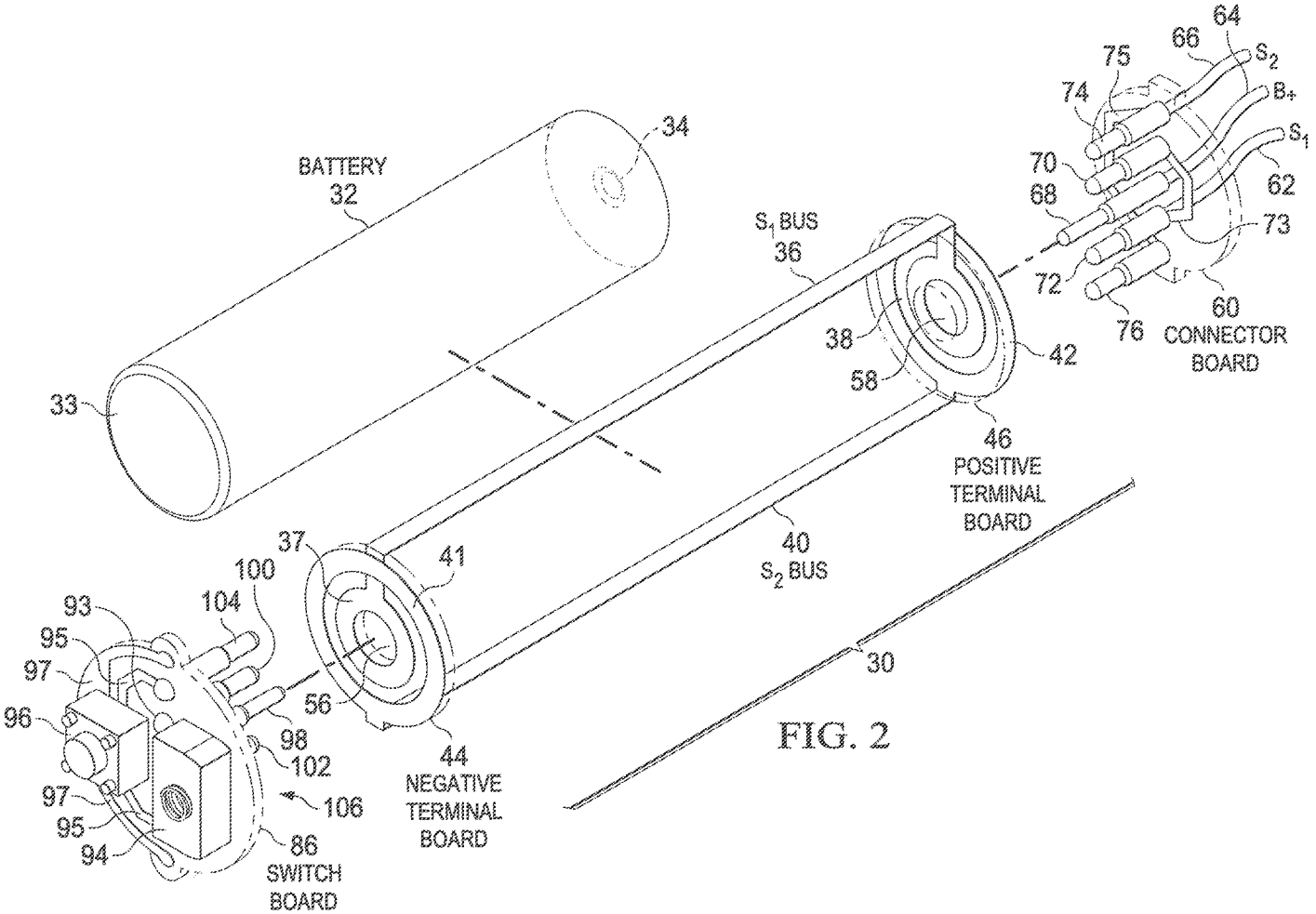
FIG. 2 illustrates an exploded view of a battery pack for use in the embodiment of FIG. 1.

The battery pack 30 includes a battery 32 (not visible in this view) disposed between a negative terminal hoard 44 and a positive terminal board 46 and enclosed within an insulated sleeve 50, as will be further described in FIG. 2. The tail cap assembly 80 includes a switch cover 84 that includes a semi-circular button 118 for activating SW1 to control the flash light emitter, and a smaller oval-shaped button 120 for activating SW2 to control the flood light emitter 18. The buttons 118 and 120 are located side-by-side within the end of the tail cap 82 for ease of access and are shaped and positioned to facilitate ease of identification and operation by touch. In an alternate embodiment, the tail cap 82 may be molded of a synthetic material that is metalized on its interior surface and the treaded portion to provide an electrically conductive surface. Further details of the tail cap assembly appear in FIG. 3.

FIG. 2 illustrates an exploded view of the battery pack assembly 30 along with the connector board 60 and the switch PC board 86, both boards shown in phantom for clarity. The battery 32 in this example may be a single cell such as a type 18650 Lithium ion cell, or two Lithium cells such as type CR-123 cells placed end-to-end. However, the battery pack is not limited to these particular cell types but may include a battery or batteries of other chemistry. In either case, a positive terminal board 46 and a negative terminal board 44 are respectively placed next to but insulated from the positive and negative ends of the battery 32.

The negative 44 and positive 46 terminal boards are two-sided printed circuits having inner 37, 38 and outer 41, 42 circular traces on the side of the PC board facing away from the respective end of the battery 32. The inner traces 37, 38 are connected via a thin metal strip 36 soldered to the inner traces 37, 38, which together provide a signal path through the battery pack 30 to the control input 142 of the control circuit 134 to control the flash light emitter 16. Similarly, the outer traces 41, 42 are connected via a thin metal strip 40 soldered to the outer traces 41, 42, which together provide a signal path through the battery pack 30 to the control input 144 of the control circuit 136 to control the flood light emitter 18. The assembly of the battery 32, the negative 44 and positive 46 terminal boards and the thin metal strips 36, 40 connecting them is preferably enclosed and secured together by an insulating sleeve 50 (see FIG. 4) to form the battery pack 30 as an integrated assembly or unit. In one embodiment, an elastic band may be disposed around the end of the negative terminal end of the battery to expand its diameter before the sleeve 50 (see FIGS. 1 and 4) is installed. This band, acting cooperatively with an expanded diameter of the housing 12 at its rearward end for example, thus may act as a key to distinguish the negative end of the battery 32 so that the battery pack 30 cannot be inserted backwards in the housing 12 of the flash light 10. The sleeve 50 may, for example, preferably be a length of heat shrink tubing placed over the assembled battery pack 30 and shrunk using a heat gun. The sleeve 50 provides electrical insulation and holds the components of the battery pack 30 in the correct assembled relationship.

Continuing with FIG. 2, a connector board 60 (shown in phantom) supports five "pogo pin" terminals to provide electrical connections between the battery pack 30 and the control circuit 132. Pin 68, connected to insulated wire 64 provides the connection from the positive terminal 34 of the battery 32 to the positive DC supply ("B+") input 150 of the control circuit 132. Note that the contact of pin 68 extends through a hole 58 in the center of the positive terminal board 46. Pins 70, 72, connected to trace 71 and insulated wire 62 provide the signal connection from SW1 to the control input 142 on the control circuit 132. Pins 74, 76, connected to trace 75 and insulated wire 66 provide signal connection from SW2 to the control input 144 on the control circuit 132. Note also that the contacts of pins 70 and 72 press against the inner ring 38 on the positive terminal board 46 to complete the SW1 signal circuit, and the contact pins 74 and 76 press against the outer ring 42 on the positive terminal board 46 to complete the SW2 signal circuit.

FIG. 2 also depicts the switch board 86 (shown in phantom), which also supports five "pogo pin" terminals (98, 100, 102, 104 and 106) to provide connection to the negative terminal board 44. Pin 98 extends through a central hole 56 in the negative terminal board 44 to provide connection from the negative terminal 33 of the battery 32 to the common (ground) circuits of the switch board 86 and the common contacts of SW1 (94) and SW2 (96). Pins 100 and 102, connected to trace 93, provide signal connection from SW1 94 to the inner trace 37 of the negative battery terminal 33. Pins 104 and 106, connected to trace 95, provide signal connection from SW2 96 to the outer trace 41 of the negative battery terminal 33. Trace 97 is connected to pin 98 and provides, via a trace 108 on the opposite side of the negative terminal board 44, a connection to a metal retaining ring 90 (to be described) and a connection to the metal housing 12 to supply a circuit ground path through the metal housing 12 to the control circuit 132 as will be described in FIG. 4.

Figure 3:
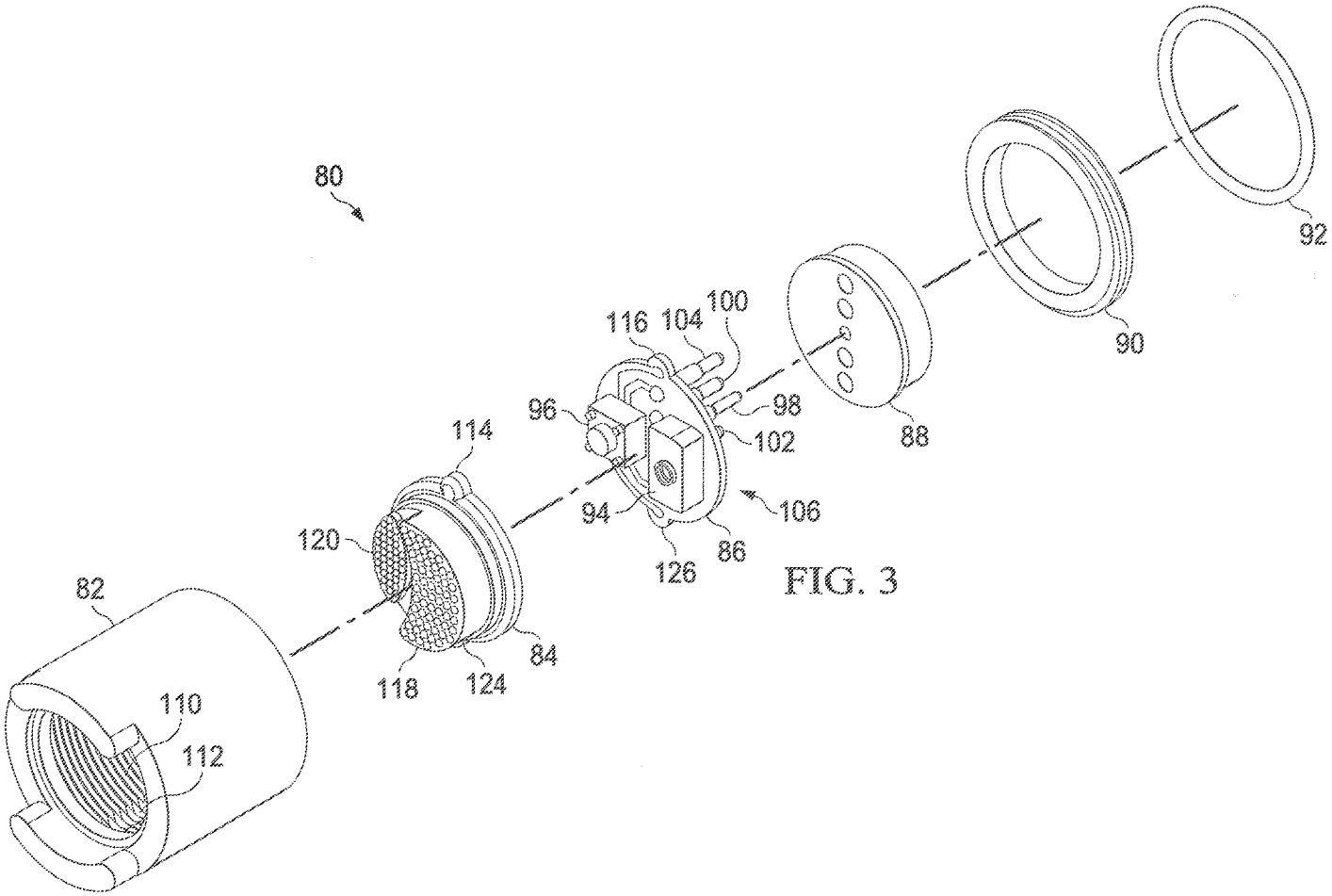
FIG. 3 illustrates an exploded view of a tail cap assembly for use in the embodiment of FIG. 1.

FIG. 3 illustrates an exploded view of the tail cap assembly 80 for use in the embodiment of FIG. 1. This enlarged perspective view depicts in order, the tail cap 82, a switch cover 84, the switch board 86, a terminal cushion 88, a metal retaining ring 90, and an O-ring 92. The switch cover 84, terminal cushion 88 and the O-ring 92 may be made of rubber or elastomeric materials. The tail cap 82 and retaining ring 88 may preferably be machined from a metal such as aluminum. The tail cap 82 includes internal threads 110 that match the external threads of the retaining ring 90 and the housing 12. A groove 112 may be provided in the internal threads 110 on opposite sides (only one side shown in this view) of the tail cap 82 to accommodate the first and second locating tabs 114, 124 on the switch cover 84 and the third and fourth locating tabs 116, 126 on the switch board 86. These tabs 114, 124, and 116, 126 are provided to align the switch cover 84 and the switch board 86 as they are installed into the tail cap 82. The switch cover 84 includes a semi-circular button 118 for activating SW2 to control the flash light emitter, and a smaller oval-shaped button 120 for activating SW1 to control the flood light emitter 18.

The tail cap 82 houses the assembly of the switch cover 84, the switch board 86 and its associated components described above in FIG. 2, and the terminal cushion 88, which is disposed over the "pogo pin" terminals 98, 100, 102, 104, and 106 to maintain the alignment of these terminals. After insertion of the assembly into the tail cap 82, the retaining ring 90 is threaded into the tail cap 80 to secure the assembly into the tail cap 82. Referring briefly to FIG. 4 it will be noted that the retaining ring 90, when viewed in cross section, surrounds the cushion 88 and is in direct contact with a ground trace 108 that is disposed around the perimeter of the proximate side of the switch PC board 86. The ground trace 108 may also be connected through plated-through vias (not shown) to the PC trace 97 on the distal side of the switch board 86 and to the center terminal pin 98. The retaining ring 90 thus completes a connection between the negative terminal 33 of the battery 32, the terminal pin 98, the ground traces 97 and 108 on the switch board 86, the retaining ring 90 and the tail cap 82. The tail cap may then be threaded onto the housing 12 after the O-ring 92 is installed over the threaded portion 13 of the housing 12. As the tail cap assembly 80 is fully threaded onto the housing 12, the terminal pins of the switch board are placed in spring loaded contact with the negative terminal of the battery 32 and the inner 37 and outer 41 circular traces on the negative terminal board 44.

FIG. 3 also illustrates a view of the component side of the switch board 86 of FIG. 2. Shown in this view are the flash light switch SW1 94 and the flood light switch SW2 96. The flash light switch 94 in this example may be a normally open ("N.O.") snap-action, dome type of switch that has a dual mode action. That is, the initial pressure closes one set of contacts to operate one mode. Further pressure to a fully pressed condition closes a second set of contacts to operate another mode after opening the first set of contacts. In one example, a first mode may be a momentary mode, that is, when the switch button SW1 is released after the initial contact, the light is extinguished. In the second mode, the light may remain ON upon release of the switch button and extinguished to OFF upon a second operation of the switch SW1. In another example, the brightness level may be selected by holding the switch button pressed or by pressing it each time, in sequence (for example), a different brightness is desired. Further, the switch may be pressed twice in rapid succession to select a strobe mode. Other mode combinations may be incorporated into the sequences programmed into the microcontroller U1 (160) for the flash light emitter 16 as it is controlled by SW1.

The flood light switch 96 in this example may be a normally open single pole switch that may be operated in a sequence according to a program to select first and second brightness levels of the flood light beam. Alternatively, the flood light switch 96 may be a single pole, single throw switch having latching contacts in certain applications. The flash light SW1 and flood light SW2 switches engage separate inputs of the programmed low power microcontroller U1 (160) to control the modes. As described previously, the switches connect the common return circuit from the negative terminal of the battery to pull LOW the respective control inputs 142, 144 of the microcontroller 160 to activate the corresponding controlled circuit 134 (flash LED) or 136 (flood LED).

FIG. 4 illustrates a pictorial schematic drawing of the electrical and mechanical relationships of the embodiment of FIGS. 1, 2 and 3 to highlight the novel features of the invention. This view illustrates how the switch board 86 in cooperation with the negative terminal board 44, the positive terminal board 46 and the insulated wires 62, 64 provide a signal connection through the common return circuits from the negative terminal of the battery 32 to the control inputs 142, 144 of the control circuit 132. These connections enable pulling those inputs LOW to activate the functions of the control circuits 134, 136 for the flash light and flood light emitters 16, 18. The connection to supply the common return connection from the negative terminal 33 of the battery 32 to the common side of the control circuit 132 is provided via the trace 108 on the negative terminal board 44 (which is also connected through plated-through vias on the negative terminal board 44 to a trace 97 that is not shown for clarity), the retaining ring 90, the housing 12, and the bare wire contact 140.

FIG. 4 illustrates how the three pre-assembled modules: the control circuit assembly 14, the battery pack assembly 30, and the tail cap assembly 80 are enclosed within the metal housing 12. These structural features minimize assembly tasks yet provides all the necessary electrical functionality of a tactical light that operates two independent light beams from independently operable switches located together on the tail cap to enable operation with a thumb or an index finger of the hand the holds the tactical flashlight 10. Two additional features that enable this combination to function include (A) using the metal housing as a common return side of the battery circuit; and (B) configuring the control circuit as a low power microcontroller that is idle except when a control input is pulled LOW to activate the LED control circuits.

Continuing with FIG. 4 the battery pack 30 and the control circuit 132 are enclosed within the tubular metal housing 12. The control circuit 132 includes and is connected to the connector board 60, and to the flash LED 16 and the flood LED 18, as shown and previously described. The flash LED 16 is supported in the lens cap 24 that is threaded onto the housing 12 via the threads 21, 25. The battery pack 30 includes the battery 32, the negative 44 and positive 46 terminal boards, the flash 36 and flood 40 signal lines, all contained within an insulating sleeve 50 as shown. The tail cap 82 includes the switch board 86 with its terminal pins 98, 100 and 106, the switches 94, 96 (respectively SW1 and SW2), the switch buttons 118, 120, and the terminal cushion 130 and the threaded metal retaining ring 90. When the tail cap 82 is threaded on to the housing 12 (at threads 13 and 110) the negative terminal of the battery 32 is connected via the terminal pin 98, the ground circuit trace 108, the metal retaining ring 90, and the metal tail cap 82 to the metal housing 12. As described previously, this circuit common or ground connection is completed to the control circuit 132 via the wire contact 140 that connects the metal housing 12 to the control circuit ground.

In other details, the control circuit 132 may include a flash emitter circuit A (134) to control and supply current for the flash LED 16 and a flood emitter circuit B (136) to control and supply current for the flood LED 18. Both flash 134 and flood 136 circuits are connected to a DC voltage source (B+) 150 and a common return or ground 140. As noted previously, the control circuit 132 is always energized—i.e., live when the battery pack is installed in the housing 12—because the negative 33 and positive 34 terminals of the battery are always connected via the respective terminal boards 44, 46 to the control circuit 132 through other intervening structures as described. This configuration eliminates the need for on ON/OFF switch because the low power microcontroller used in the control circuit is configured to draw no more than 1.5 microamprere when in sleep mode. The connector board 60 wired to the control circuit 132 via the wires 62, 64, and 66 includes spring-loaded terminal pins 68 (for the positive DC voltage supply), and 70, 76 for coupling the signaling inputs to the respective SW1 control input 142 and the SW2 control input 144 of the control circuit 132 from the respective conductor paths in the battery pack 30.

The battery pack 30 is a self-contained assembly within an insulated sleeve 50. The battery 32 is disposed between a negative 44 and a positive 46 terminal board configured to connect with the spring-loaded terminal pins of the switch board 86 and the connector board 60 as described.

The tail cap assembly 80 contains the switch board 86 and the switches 94 (flash) and 96 (flood) that enable connection, when operated by the user, of the negative terminal 33 of the battery 32 through the switch contacts and other structures in the battery pack assembly 30 and the control circuit assembly 14 to the control circuit inputs 142 and 144. The tail cap assembly 80 is also configured with the metal retaining ring 90 to connect the negative terminal 33 of the battery 32 to the tail cap 82 and metal housing 12 to supply the common return path to the control circuit 132.

Figure 5:
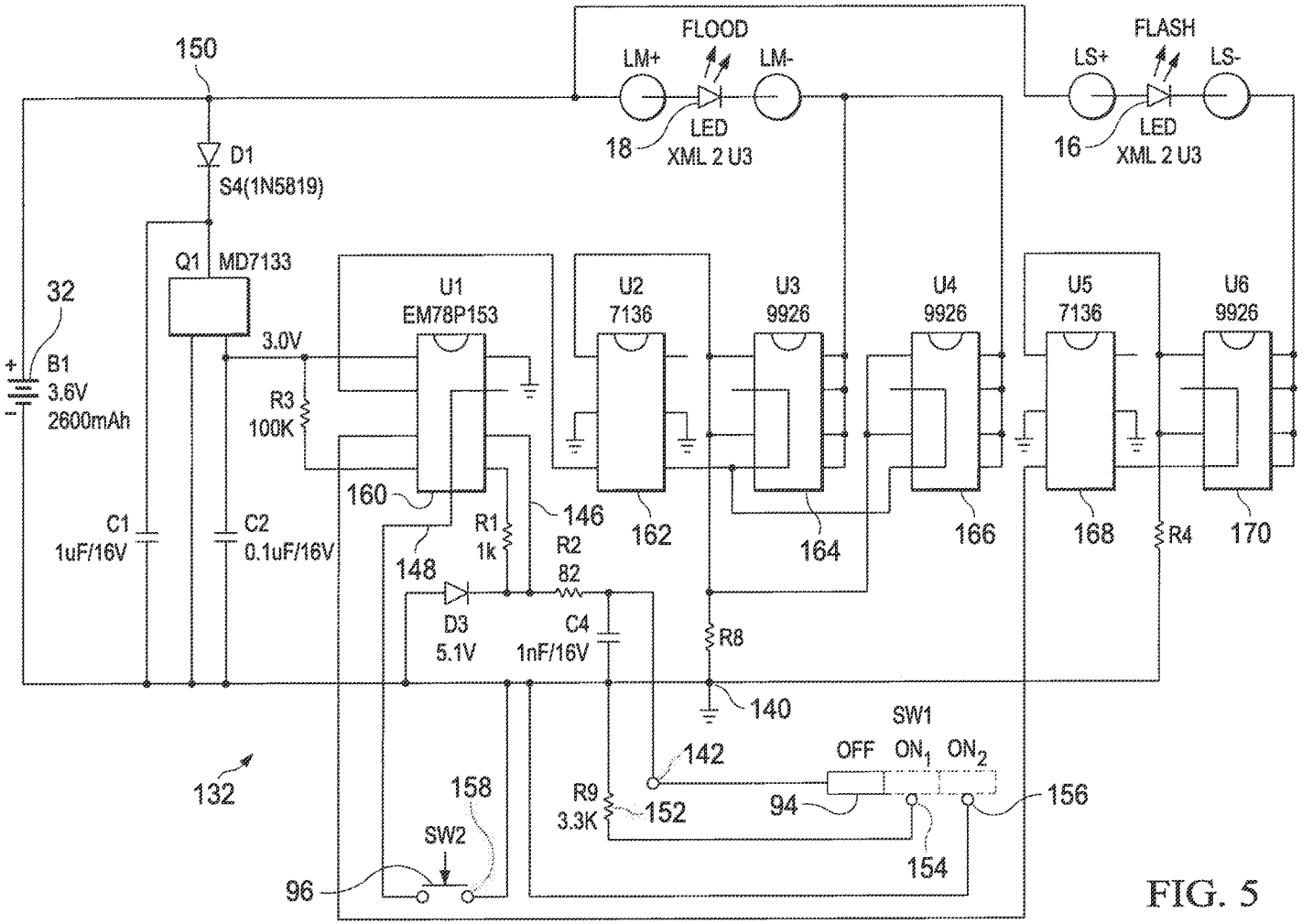
FIG. 5 illustrates a schematic circuit diagram of the control circuit for use in the embodiment of FIG. 1.

FIG. 5 illustrates a schematic circuit diagram of the electrical circuits in the control circuit assembly 14 of the embodiment of FIG. 1. Switch SW1 (94) and integrated circuits U1 (160), U5 (168), and U6 (170) form the flash light control circuit 136. SW1 (94) acts to pull LOW the control input 146 of the microcontroller U1 (160) to activate the flash light LED 16 according to a sequence programmed into the memory of the microcontroller U1. Switch SW2 (96) and integrated circuits U1 (160), U2 (162), U3 (164) and U4 (166) form the flood light control circuit. SW2 (96) acts to pull LOW the control input 148 of the microcontroller U1 (160) to activate the flood light LED 18 according to a sequence programmed into the microcontroller U1. Note that the control input 146 is connected to the input 142 on the connector board 60 and the control input 148 is connected to the input 144 on the connector board 60. Switch SW1 (94) may a snap action dome switch (see the description of FIG. 3) acting in concert with printed circuit contacts 154, 156 on the switch board 86 to provide a switch action similar to single pole double throw (SPDT). Switch SW2 (96) may be a self-contained single pole single throw (SPST) switch to provide a connection via contact 158 to circuit common 140. SW2 (96) may also preferably be a snap action switch.

SW1 (94) and SW2 (96) provide connection to the common return path 140 of the electrical circuits in the tactical light 10, thereby providing respective pull-down signals to first 146 and second 148 inputs of the microcontroller U1 (160). SW1 (94) provides either a connection through resistor 152 (in this example, a 3.3 KOhm resistor) and contact 154 to common 140 or a connection directly to common through contact 156, respectively for controlling different modes of the flash emitter 134 control circuit. SW2 (96) provides a connection through contact 158 directly to common 140 for controlling operation of the flood emitter 136 control circuit.

The control circuit 134 for the flash LED 16 includes the microcontroller U1 (160), an LED driver U5 (168), and a single MOSFET U6 (170) as an output stage. The control circuit 136 for the flood LED 18 includes the microcontroller U1 (160), an LED driver U2 (162), and two MOSFETs U3 (164) and U4 (166) connected in parallel as an output stage.

Accordingly, in one embodiment, a dual independent switch assembly for a flash light housed in a tubular metal housing enclosing a battery pack is described. A control circuit having first and second inputs, and first and second independently operated light emitters are included in the housing. The dual independent switch assembly comprises a switch assembly including independent first and second single pole switches mounted next to each other on a switch board within a removable metal tail cap, each switch having a first contact coupled with a first common circuit to a first battery terminal and to the metal tail cap; wherein a second contact of the first switch is coupled via a first conductor path disposed through the battery pack to the first control circuit input for controlling activation of the first light emitter; and a second contact of the second switch is coupled via a second conductor path disposed through the battery pack to the second control circuit input for controlling activation of the second light emitter; wherein the battery pack is electrically connected to and energizes the control circuit when the battery pack is installed in the housing.

While the invention has been shown in only a few of its forms, it is not thus limited but is susceptible of various changes and modifications without departing from the spirit thereof. For example, while a single cylindrical battery cell is illustrated and described herein, other battery shapes may be accommodated as long as the terminal boards for the positive and negative terminals may be assembled with the battery cell in the manner described and illustrated in the foregoing description. Further, the battery pack is not limited to one particular cell chemistry but may include a battery of other chemistry or may include multiple cells. In some embodiments, the battery may be reversed in the housing to accommodate control circuitry that operates with a different polarity of DC supply or signaling to the control circuit.

Moreover, the scope of the invention as claimed includes a variety of ways, via passive or active circuitry for example, that the control signals for operating the light emitters, whether they are parts of the common return circuit or apart from the common return circuit, may be communicated from the switches on the tail cap through the battery pack to the control circuit inputs. The battery pack may include the region between the tail cap and the control circuit in the forward end of the housing. The control signals coupled through the battery pack may be imprinted on flexible substrate material.

In addition, other types of switch mechanisms located in the tail cap may be used to provide the independent switch control of the separate light emitters, according to the physical constraints of the tail cap assembly or the particular illumination modes programmed into the microcontroller. The light emitters may be single or multiple light emitting diodes or other types of emitters.

What is claimed is:

1. A dual independent switch assembly for a flash light housed in a tubular metal housing enclosing a battery pack, a control circuit having first and second inputs, and first and second independently operated light emitters, comprising:

a switch assembly including independent first and second single pole switches mounted next to each other on a switch board within a removable metal tail cap, each switch having a first contact coupled with a first common circuit to a first battery terminal and to the metal tail cap; wherein a second contact of the first switch is coupled via a first conductor path disposed through the battery pack to the first input of the control circuit for controlling activation of the first light emitter;

a second contact of the second switch is coupled via a second conductor path disposed through the battery pack to the second input of the control circuit for controlling activation of the second light emitter;

a battery pack including a cylindrical battery, having a positive and a negative terminal disposed at opposite ends of the battery with respective first and second terminal boards each having circular conductive patterns on both sides thereof, connected by vias, and disposed concentric with a central opening; and a thin insulating sleeve enclosing the battery, the first and second terminal boards and the first and second conductors; wherein the outer circular conductive patterns on the first and second terminal boards are electrically connected to the first conductor and the inner conductive patterns on the first and second terminal boards are electrically connected to the second conductor; and wherein the battery pack is electrically connected to and energizes the control circuit when the battery pack is installed in the housing.

2. The assembly of claim 1, wherein:

a first battery terminal is a negative terminal and a second, positive battery terminal is connected to the control circuit; and the first and second control circuit inputs are pulled low to control activation of the respective first and second light emitters.

3. The assembly of claim 1, wherein:

a first battery terminal is a positive terminal and a second, negative battery terminal is connected to the control circuit; and the first and second control circuit inputs are pulled high to control activation of the respective first and second light emitters.

4. The assembly of claim 1, wherein:

each first and second switch includes a push button actuator in the metal tail cap for independently connecting the first battery terminal to the first and second control circuit inputs via the respective first and second signal conductors and closed contacts of the first and second switches.

5. The assembly of claim 1, wherein:

the first and second switches include respective first and second push button actuators disposed in proximate relationship on an end of the metal tail cap.

6. The assembly of claim 1, wherein the first conductor path comprises:

a first connected series of conductors on the switch board, a rearward battery terminal board, a first metal strip, a forward battery terminal board, an intermediate pc board, a wire, and a signal input conductor on the control circuit.

7. The assembly of claim 1, wherein the second conductor path comprises:

a second connected series of conductors on the switch board, a rearward battery terminal board, a second metal strip, a forward battery terminal board, an intermediate connector board, a wire, and a signal input conductor on the control circuit.

8. The assembly of claim 1, including a third conductor path comprising:

an electrical connection from the first battery terminal through the first common circuit on the switch assembly, a metal retaining ring, the metal housing, a contact spring, and a second common circuit on the control circuit to provide a common return connection between the first battery terminal and the control circuit.

9. The assembly of claim 1, wherein:

the control circuit is provided by a programmed, low-power microcontroller that is configured to remain in a sleep mode except when either first or second switch is operated by a user.

10. The assembly of claim 1, wherein:

the microcontroller is configured to draw less than 2 microAmperes during the sleep mode.

11. The assembly of claim 1, wherein:

the flashlight does not require an ON/OFF switch.

12. The assembly of claim 1, wherein:

the first and second switches include respective first and second push button actuators disposed in proximate relationship on the side of the tail cap.

13. A tactical carry light having first and second independently switched light emitters, comprising:

a cylindrical battery adjoining a forward battery terminal board having a central opening for access to a positive terminal of the batter at a first end thereof and a rearward battery terminal board having a central opening for access to a negative terminal of the battery at a second end thereof;

first and second conductors disposed proximate the battery and connecting respective first and second conductive traces of the forward battery terminal board to corresponding respective first and second conductive traces of the rearward battery terminal board;

on the faces of the forward and rearward battery terminal boards respectively opposite the battery, separate inner and outer circular conductive traces disposed surrounding the central opening, wherein the first conductor is connected to the inner conductive traces of the terminal boards and the second conductor is connected to the outer conductive traces;

a switch assembly including first and second switches for independently controlling the first and second light emitters powered by the battery, the switch assembly having conductors disposed in contact with the negative terminal of the battery and the first and second conductive regions on the rearward battery terminal board; and a control circuit powered by the battery and coupled with the first and second conductive regions of the forward battery terminal board and the positive terminal of the battery; and a sleeve of insulating material enclosing the battery, the first and second conductors, and the edges of the forward and rearward battery terminal boards adjoining respective ends of the battery.

14. The tactical carry light of claim 13, wherein the control circuit comprises:

a programmed, low-power microcontroller that is configured to remain in a sleep mode except when either first or second switch is operated by a user; and the microcontroller is configured to draw less than 2 microAmperes during the sleep mode.

15. The tactical carry light of claim 13, wherein:

the battery is electrically connected to and energizes the control circuit when the battery is installed in the housing.

16. The tactical carry light of claim 13, wherein the cylindrical battery comprises:

at least two or more cylindrical cells disposed end-to-end.

17. The tactical carry light of claim 13, wherein the first and second conductors comprise:

thin metallic strips connected between respective conductive traces on the forward and rearward battery terminal boards.

18. The tactical carry light of claim 13, wherein the sleeve of insulating material comprises:

a thermoplastic heat shrink tubing material.

19. The tactical carry light of claim 13, comprising:

a coupling circuit board having spring-loaded pins for connecting to conductive traces on the forward battery terminal board and the positive terminal of the battery; and flexible conductors for connecting the coupling circuit board to the control circuit.

20. The tactical carry light of claim 13, wherein the switch assembly comprises:

a first switch having normally open contacts operable in a snap-action sequence; and a second switch having normally open, single pole latching contacts.

21. The tactical carry light of claim 13, wherein the switch assembly comprises:

a switch circuit board having spring-loaded pins for connecting to conductive traces on the rearward battery terminal board and the negative terminal of the battery.

22. The tactical carry light of claim 13, wherein:

the first switch controls an axially-directed flash light beam emitted by a first emitter according to a predetermined sequence including at least two beam intensities and at least one strobe light mode.

23. The tactical carry light of claim 13, wherein:

the second switch controls a laterally-directed flood light pattern emitted by a second emitter in at least an on-off sequence.

* * * * *